United States Patent [19]

Williams et al.

[11] Patent Number: 4,735,414

[45] Date of Patent: Apr. 5, 1988

[54] ADJUSTABLE GOLF CLUB

[76] Inventors: Joseph Williams, 13300 Indian Rocks Rd., Largo, Fla. 33544; Joseph L. La Mura, 367 Passaic Ave., West Caldwell, N.J. 07006

[21] Appl. No.: 20,699

[22] Filed: Mar. 2, 1987

[51] Int. Cl.[4] ..... A63B 53/06

[52] U.S. Cl. ..... 273/79; 273/80.1; 273/168

[58] Field of Search ..... 273/79, 80 C, 80.1, 273/80.2, 167 G, 168; 403/96, 328, DIG. 6

[56] References Cited

U.S. PATENT DOCUMENTS

| | | | |
|---|---|---|---|
| 198,383 | 6/1964 | Butler . | |
| 1,599,336 | 9/1926 | Lindgren | 273/80.1 |
| 2,661,952 | 12/1953 | Jackson | 273/80.1 |
| 3,096,982 | 7/1963 | Bassin | 273/80.1 |
| 3,204,962 | 9/1965 | McCormick | 273/80.1 |
| 3,206,206 | 9/1965 | Santosuosso . | |
| 3,214,170 | 10/1965 | Warnock | 273/80.1 |
| 4,240,636 | 12/1980 | Swenson | 273/169 |
| 4,289,311 | 9/1981 | Smith | 273/167 |
| 4,508,342 | 4/1985 | Drake | 273/80 C |
| 4,519,612 | 5/1985 | Tsao | 273/163 R |
| 4,523,758 | 6/1985 | Guendling, Jr. | 273/77 R |

*Primary Examiner*—Richard C. Pinkham
*Assistant Examiner*—William E. Stoll

[57] ABSTRACT

A pivot assembly includes a shank member to which a club shaft is attached. A connecting member having detent balls is attached to the shank member from which a dirt shield and a bearing disc depend. The disc has a pair of bearing faces and includes a pair of journal bearings extending therefrom. The head has a hollow core in which are a pair of facing ring bearings which engage the disc bearing faces and journal bearings. A pair of abutments upstand from the head assembly outside the cavity and are formed with first and second sets of depressions at different spacings from a reference plane. As the shaft is rotated from one extreme position to the other, the detent balls engage the depressions in one abutment or the other alternately to provide closely spaced detent positions of the club shaft.

13 Claims, 3 Drawing Sheets

FIG. 1
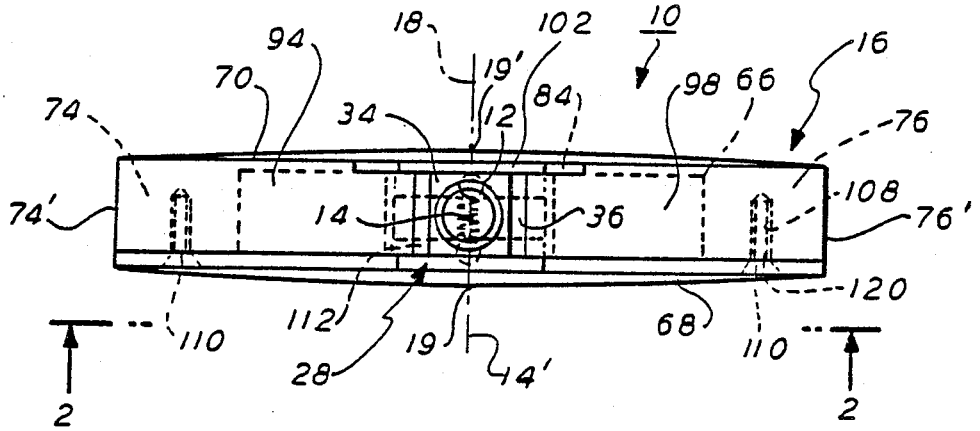
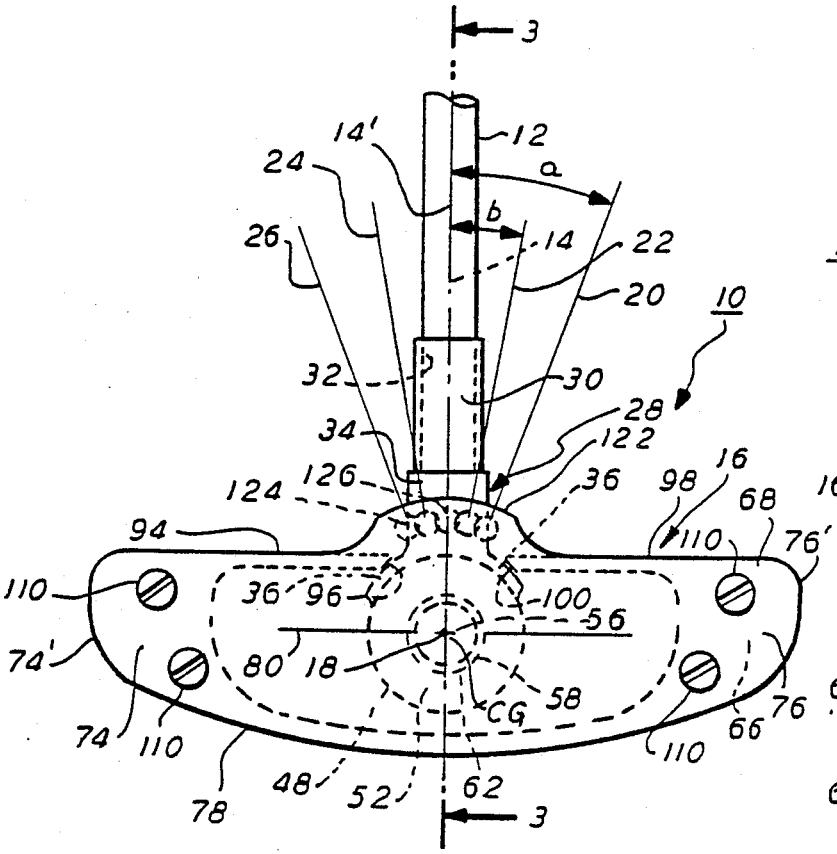
FIG. 2
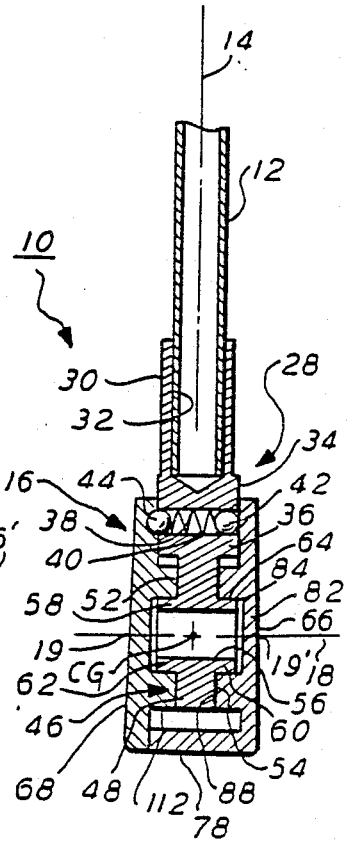
FIG. 3

ADJUSTABLE GOLF CLUB

This invention relates to an adjustable golf club and, more particularly, to an adjustable club with detent means.

In U.S. Pat. No. 2,661,952 a double faced club is described employing ball detent means for providing a "four" position club. The shaft is detented to the club head to provide two shaft positions. The head is double faced to permit right and left hand use. The shaft has two positions. Balls on opposite sides simultaneously engage detent depressions. Two separate sets of balls and springs are thus required. Also, a relatively large opening exposes the moving parts to foreign matter. The present inventors recognize a need to provide a greater number of detent positions employing a simpler system.

In U.S. Pat. No. 3,204,962 a detent system uses a peaked member and a plurality of closely spaced detent notches. This arrangement in practice while providing more detent positions than the ball and socket system is subject to the drawback of greater wear due to the relatively high friction contact of the peak to the notches. Further, this system may be relatively difficult to set to a given notch due to eventual notch wear and the close notch spacing. The present inventors recognize a need for an adjustable club which can easily be set to a desired setting instantly and reliably and includes staggered relatively widely spaced detents not subject to significant wear.

In U.S. Pat. No. 3,096,982 an adjustable club includes a retaining mechanism which makes it difficult to adjust during play. The mechanism includes a tensioning system which needs to be tightened and loosened making the system cumbersome to use. Graduated markings are needed to set the position of the shaft. Further, the moving parts are exposed to ambient atmosphere and subject to contamination. This system also requires tools to set the club positions.

U.S. Pat. No. 1,599,366 shows a two position adjustable club. Other adjustable clubs are disclosed in U.S. Pat. Nos. 3,206,206, 3,214,170 and 4,519,612 which suffer from drawbacks similar to those discussed above.

The present inventors recognize a need for a symmetrically balanced adjustable golf club which is capable of a number of small incremental angular adjustments about its center of gravity and which are easily made without tools, without graduated markings, are reliably repeatable, provide a good "feel" to the user wherein the system is locked securely where set, has an esthetically pleasing appearance, is sturdy, will survive a large number of adjustments without appreciable wear, and the moving parts are tight fitting to minimize undesirable movement therebetween. A need is also seen for such a club in which the moving elements are protected from foreign matter which might otherwise interfere with the adjustment mechanism.

A golf club according to the present invention comprises a shank member for receiving a club shaft on a shaft axis. A club head has a cavity formed by a pair of opposed facing side walls. Bearing means secured to the shank member and to the club head in the cavity define a shaft pivot axis for rotatably securing the shank member to the club head for rotation about the pivot axis. Ball detent means are coupled to the shank member and club head for angularly positioning the club head at different angular orientations relative to the shaft axis.

The detent means includes a pair of detent balls resiliently secured to the shank member and aligned on a straight line spaced a given distance from and parallel to the pivot axis, each ball facing a different side wall. A plurality of spaced depressions are in each facing side wall. The depressions in each side wall are spaced the given distance from the pivot axis. The depressions in one wall have a first spacing to a reference plane. The depressions in the other side wall have a second spacing to the reference plane different than the first spacing so that only one of the pair of detent balls engages a facing depression in any selected angular position of the shank member relative to the head.

In The Drawing

FIG. 1 is a plan view of a golf club according to one embodiment of the present invention;

FIG. 2 is a side elevation view of the embodiment of FIG. 1 taken along lines 2—2;

FIG. 3 is a sectional view of the embodiment of FIG. 2 taken along lines 3—3;

Figure 4:
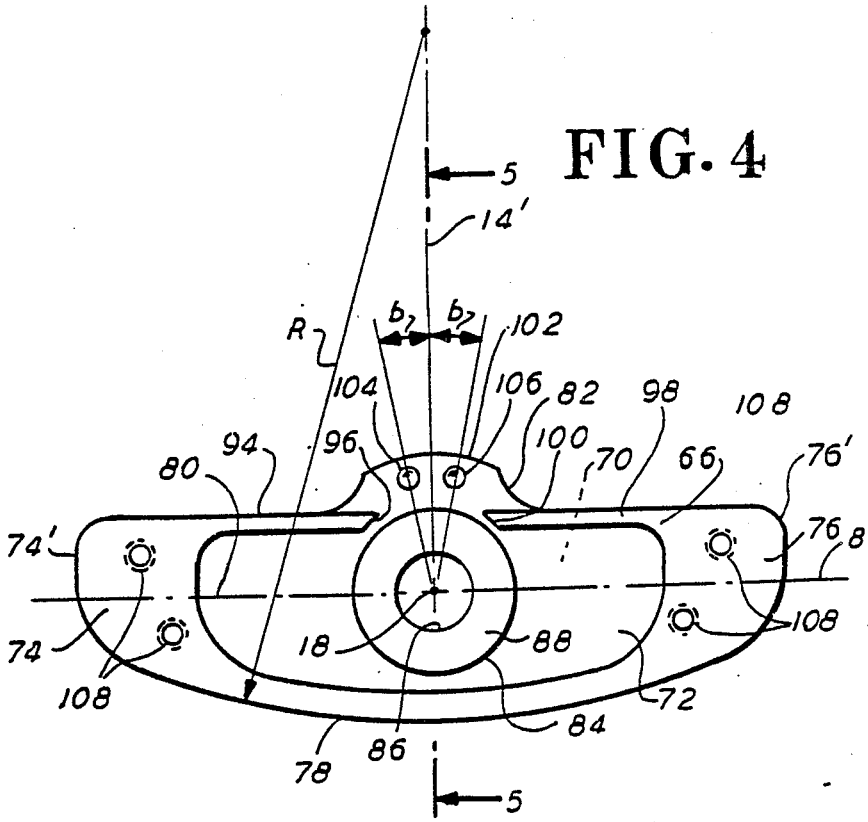
FIG. 4 is a side elevation view of a head member portion of the club head of the embodiment of FIG. 1.
Figure 5:
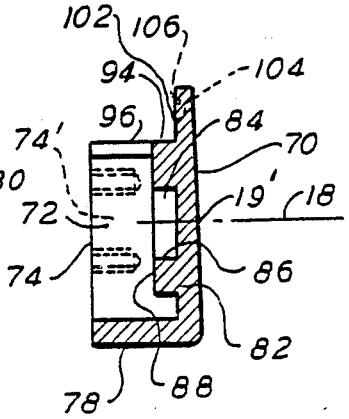
FIG. 5 is a sectional end elevation view of the embodiment of FIG. 4 taken along lines 5—5.

In FIGS. 1, 2 and 3, golf club 10, which may be a putter, comprises a shaft 12 having a shaft axis 14 pivotally secured to head assembly 16 about pivot axis 18. Shaft axis 14 is normal to pivot axis 18 in all positions of the shaft. Shaft 12 is rotatable from the vertical position of axis 14 in plane 14' as shown to angularly displaced positions represented by lines 20, 22, 24, and 26, FIG. 2. The positions represented by lines 22 and 24 are at the same angle b from reference plane 14' which angle may be 10° in the preferred embodiment. Plane 14' is defined by axes 14 and 18 with axis 14 in the position shown. Lines 20 and 26 are at the same angle a from plane 14' which may be 20° in the preferred embodiment. While five positions of shaft 12 are illustrated, more or fewer may be provided in accordance with a given implementation. These positions permit the club to be used by a right or left handed golfer. The 10° and 20° shaft angles permit the club to be used as a pendulum putter or as a more conventional putter, which use is shown, for example, in Pat. No. 4,523,758 with the shaft 12 at lines 20, 22, 24 or 26.

Figure 8:
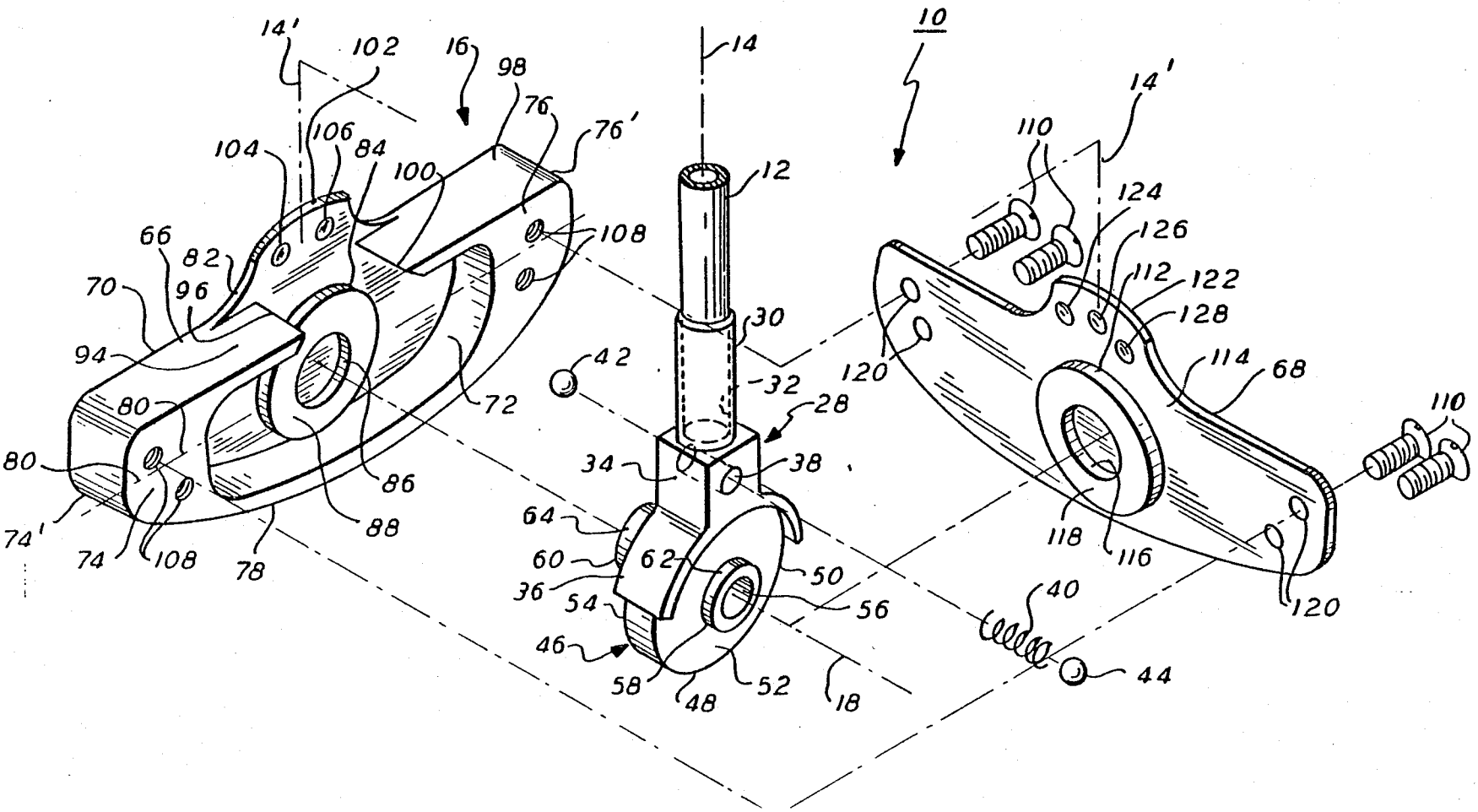
FIG. 8 is an exploded view of the club embodiment of FIG. 1.

Shaft 12 is connected to shank pivot assembly 28 which comprises a shank 30 having a socket 32 for receiving shaft 12. Depending from shank 30 is connecting member 34, which may be somewhat cubic in shape. Depending from member 34 is a circular segment cylindrical dirt shield 36 (FIG. 8). A circular cylindrical bore 38 passes linearly through member 34 spaced a given radial distance from axis 18. A compression spring 40 is in bore 38. A pair of detent balls 42 and 44 are at opposite ends of the bore in engagement with spring 40. Spring 40 urges balls 42 and 44 out of engagement with bore 38. Balls 42 and 44 are aligned on that straight line of bore 38 of that given radial distance from pivot axis 18.

A bearing assembly 46, FIGS. 3 and 8, depends from connecting member 34. Assembly 46 comprises a circular cylindrical disc 48 which depends from member at peripheral disc edge 50. Edge 50 is integral with shield 36 where connected. Disc 48 has two parallel bearing side faces 52 and 54 which are parallel to shaft axis 14. A bore 56 is in disc 48 concentric about axis 18. A pair of identical journal bearings 58 and 60 extend in opposite directions from respective faces 52 and 54 of disc 48. Bearings 58 and 60 have respective coextensive external circular cylindrical journal bearing surfaces 62 and 64. The assembly 28 and head assembly may be formed of ferrous or nonferrous metals, e.g., brass.

In FIG. 8, head assembly 16 comprises a head member 66 and a head cover 68. Head member 66 has a golf ball impact face 70. Member 66 has a hollow core 72 and a pair of balanced relatively high inertia masses 74 and 76 at head toe 74' and heel 76', respectively. In FIG. 4, head member 66 has a sole surface 78 which is a segment of a circle of radius R. R in one implementation has a value of about 4.5 inches. Sole surface 78 is symmetrical to plane 14' which is normal to the sole axis 80. The sole surface 78 is symmetrical to a plane passing through axis 80 normal to plane 14'. The relatively small radius R of the sole surface is important because the bottom of the sole surface is essentially parallel to the ground regardless the angular postion of the shaft. This permits wide choice of shaft angles to the ground by the user.

Face 70 is exterior head side wall 82. Projecting from wall 82 in core 72 is a circular cylindrical washer-like ring bearing 84. Bearing 84 has a circular cylindrical interior bearing surface 86 which is concentric to and locates shaft pivot axis 18. Surface 86 mates with and engages external bearing surface 64 of bearing 60 of pivot assembly 28. Bearing 84 also has a broad circular bearing face surface 88 in core 72 lying in a plane normal to pivot axis 18 and parallel to shaft axis 14. Face surface 88 of bearing 84 mates with and engages bearing face 54 of disc 48.

A shoulder 94 integral with and normal to wall 82 overhangs core 72 extending inwardly toward plane 14' from toe mass 74. Shoulder 98 identical to and facing shoulder 94 extends inwardly toward plane 14' from heel mass 76 and is integral with wall 82. Shoulder 94 terminates at a tapered edge 96 spaced from and facing bearing 84. Shoulder 98 has a tapered edge 100 spaced from bearing 84 and facing edge 96. Shoulders 94 and 98 are generally parallel to sole axis 80. Wall 82 includes an abutment 102 upstanding in a region between and above shoulders 94 and 98. A pair of semi-spherical depressions 104 and 106 of like dimensions are in abutment 102. The depressions 104 and 106 are dimensioned to closely receive ball 42 in response to the resilient urging of spring 40. Depressions 104 and 106 are spaced the same radial distance from pivot axis 18 as bore 38 of pivot assembly 28. Further, in FIG. 4, depressions 104 and 106 are spaced the same angle b from plane 14'. Four threaded apertures 108 are in toe mass 74 and heel mass 76 for receiving screws 110.

Figure 6:
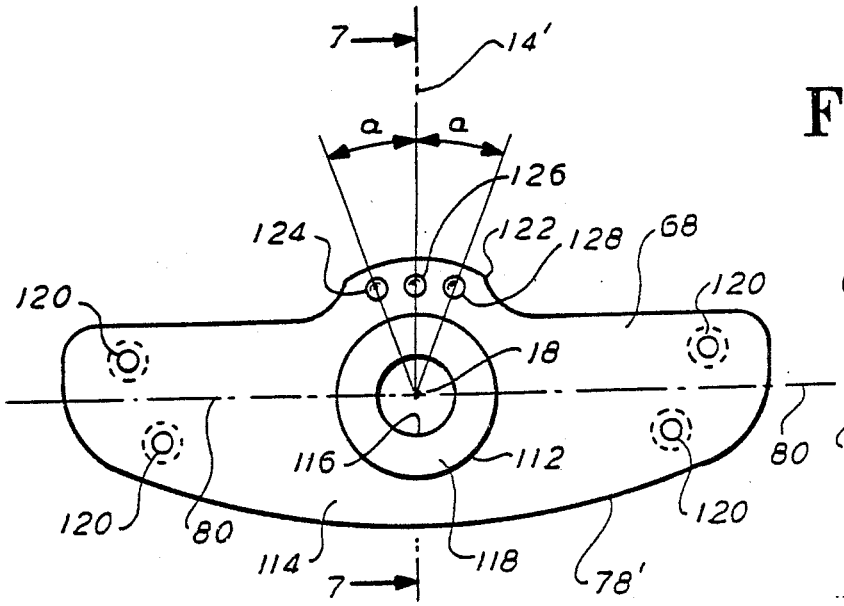
FIG. 6 is a side elevation view of a head cover portion of the head of the embodiment of FIG. 1.
Figure 7:
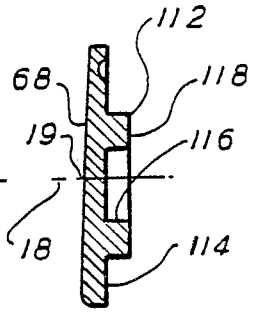
FIG. 7 is an end sectional elevation view of the embodiment of FIG. 6 taken along lines 7—7.

In FIGS. 6, 7 and 8, head cover 68 has the same perpheral shape as head member 66 and has the same thickness as wall 82 in cavity 72. In the alternative, a portion of the toe and heel masses of head member 66 may be formed on cover 68, in which case, one half the masses will be present on member 66 and the other half on cover 68. A ring bearing 112 projects from cover 68 planar surface 114 which encloses cavity 72. Bearing 112 is identical to bearing 84 of member 66. Bearing 112 has a circular inner cylindrical bearing surface 116 which receives the exterior bearing surface 62 of bearing 58 in close sliding engagement. Bearing 112 has a ring-like planar exterior bearing face 118 parallel to axis 14 and which mates with and abuts face 52 of disc 48. The various bearing surfaces and faces of pivot assembly abut and slidably engage the bearing surfaces of head assembly 16 member 66 and cover 68 within cavity 72. Screws 110 fasten cover 68 to member 66 via threaded apertures 108.

Cover 68 includes an upstanding abutment 122 identical in outline dimensions to abutment 102 on member 66. Abutment 122 has three spaced semi-spherical depressions 124, 126 and 128. The central depression 126 lies symmetrically in plane 14'. Depressions 124 and 128 are equally spaced from depression 126 the same angular extent, angle a, FIG. 2, (and the same spacing from reference plane 14'). Angle a may be about 20°. The depressions 124, 126 and 128 are also spaced the same radial distance from pivot axis 18 as bore 38 of assembly 28, FIGS. 3 and 8. The spacing angle a of the depressions 124, 126 and 128 is preferably about twice the angular spacing angle b of the depressions 104 and 106 from reference plane 14'. Therefore, the spacing of depressions 104 and 106 from each other, e.g., 20°, is the same as the spacing of depressions 124, 126 and 128 from each other. As is apparent, the depressions 124, 126 and 128 are positioned at different angular locations relative to the reference plane 14' than depressions 104 and 106. This difference in angular position of the depressions from the reference plane 14' is such that bore 38 of assembly 28, FIG. 8, is aligned with only one depression at a time. Displacement of assembly 28 about pivot axis 18 aligns bore 38 sequentially with the depressions as the assembly 28 is rotated about axis 18 from one extreme position to the other. Balls 42 and 44 alternate in their engagement with the depressions as the shaft is rotated. The position of the shaft is easily discernable to the user because of the location of the five detent positions. These positions coupled with the relatively short radius curvature of the sole surface provide all of the angular positions believed essential to practical use of the club.

The head assembly is assembled with the pivot assembly 28 mounted on the mating bearings of head member 66 and cover 68. The balls 42 and 44 are resiliently urged against the facing surfaces of abutments 102 and 122, respectively. The balls roll along these surfaces with low friction until one engages a mating aligned one of depressions 104, 106, 124, 126 and 128. This engagement provides a positive "feel" to the user of the club who can easily visually set the shaft angular position without graduations. The bearings provide a snug fit precluding play between the moving parts, which play is unacceptable. The club head mass center of gravity is substantially at the intersection of axes 18 and 14. That is, the combined masses of cover 68, member 66 and assembly 28 have their mass center of gravity located at about the intersection of axis 14 and 18. The c.g. location provides a balanced "feel" regardless which angular position the shaft is placed in. The shaft 12 when rotated always has its axis passing through the head c.g. and axis 18. Further, the ball impact points 19, 19' on the cover 68 and member 66, respectively, lie substantially on the pivot axis 18.

The shield 36, FIG. 8, because it is closely spaced from the tapered edges 96 and 100 of shoulders 94 and 98, respectively, precludes significant contamination of the moving parts with foreign matter.

What is claimed is:

1. A golf club comprising:

a shank member for receiving a club shaft on a shaft axis;

a club head having a cavity formed by a pair of opposed facing side walls;

bearing means defining a shaft pivot axis secured to the shank member and to said club head in said cavity for rotatably securing the shank member to the club head for rotation about the pivot axis; and ball detent means coupled to the shank member and club head for angularly positioning the club head at different angular orientations relative to the shaft axis, said detent means including a pair of detent balls resiliently secured to said shank member and aligned on a straight line spaced a given distance from and parallel to the pivot axis, each ball facing a different side wall, a plurality of spaced depressions in each said facing side walls, the depressions in each side wall being spaced said given distance from said pivot axis, the depressions in one side wall having a first spacing from a reference plane, the depressions in the other side wall having a second spacing different than the first spacing from the reference plane so that only one of said pair of detent balls engages a facing depression in the corresponding angular position of said shank member relative to said head.

2. The club of claim 1 wherein said detent means includes a circular opening in and through said shank member intersecting said shaft axis, a compression spring in said opening, and a pair of balls, one ball in contact with the spring at one opening end and the other ball in contact with the spring at the other opening end.

3. The club of claim 1 wherein the head defines a sole axis normal to the shaft axis in one angular position of the shank member, a pair of depressions in one side wall equally spaced a first value from the reference plane, the depressions in the other side wall comprising three depressions spaced a second different value than the first value from the reference plane and having a central depression aligned on said reference plane in the one angular position.

4. The club of claim 1 wherein said shank member includes a connecting member secured thereto, said opening passing through said connecting member, said bearing means being secured to the connecting member on the shaft axis, said opening being between said bearing means and said shank member.

5. The club of claim 1 wherein said head has a mass center of gravity substantially at the intersection of said pivot and shaft axes, said pivot axis lying within the ball impact region of said club head.

6. The club of claim 1 wherein said depressions are arranged so that the balls alternately engage their mating depressions as the shaft is rotated from one extreme position to the other.

7. A golf club comprising:

a shank member for receiving a club on a shaft axis;

a circular cylindrical disc secured at its edge to the shank member, said disc having a pair of spaced planar circular faces parallel to said shaft axis, said disc including a pair of circular cylindrical journal bearings extending from each face thereof, each bearing having a circular cylindrical bearing surface concentric with and defining the same shaft pivot axis;

a pair of spaced balls resiliently secured to the shank member aligned on a line parallel to said pivot axis and spaced from the pivot axis a given distance; and first and second head members defining a hollow cavity for receiving said disc, each said head member including a circular cylindrical ring-like bearing secured thereto in the cavity, each ring-like bearing having a circular cylindrical surface concentric with the pivot axis for closely receiving and mating with a different one of said journal circular cylindrical bearing surfaces, said ringlike bearing having a circular end face parallel to and abutting a different one of said disc faces;

one of said head members having a first plurality of spaced depressions, each for receiving one of said balls and spaced from said pivot axis said given distance, the spacing of the depressions from a reference plane having a first value;

the other of said head members having a second plurality of spaced depressions each for receiving the other of said balls and spaced from the pivot axis said given distance, the spacing of the second plurality of depressions from the reference plane having a second value different than the first value, said depressions and balls being arranged so that only one ball is engaged with a corresponding depression in any given angular position of the shank member.

8. The club of claim 7 wherein said shank member has a socket for receiving said club shaft and includes a connecting member, said connecting member having an opening therethrough, a spring in said opening, and said balls in said opening at each opening end in contact with said spring, said disc being tangentially secured to said connecting member at a side opposite said socket, and a circular segment shield member secured to the connecting member adjacent to the disc between the opening and disc.

9. The club of claim 7 wherein one of said head members has toe and heel masses symmetrical relative to said pivot axis, the other of said head members comprising a planar plate from which one of said ring-like bearings projects, the mass center of gravity of said head lying substantially at the intersection of said pivot and shaft axes, at least one of said head members has a ball impact face defining a ball impact point, said pivot axis substantially intersecting said ball impact point.

10. A golf club comprising:

a club head having a hollow core, said head having a first golf ball impact surface and including a first ringlike bearing having a cylindrical bearing surface and a planar face bearing surface defining a bearing axis, said head having a wall facing a region outside said core with a first set of depressions equally spaced in radial directions a given distance from the bearing axis, the depressions having a first spacing value from a reference plane;

a head cover having a second ball impact surface, said cover including a second ring-like bearing member projecting therefrom and having a cylindrical bearing surface and a planar face bearing surface aligned on the bearing axis, said cover including a second set of depressions equally spaced in a radial direction from said bearing axis said given distance, the second set of depressions having a second spacing relative to said reference plane different than the spacing of the first set of depressions;

a pivot shank member arranged to receive a club shaft on a shaft axis which intersects said bearing axis, said shank member having a transverse bore positioned to align with a selected one of said depressions, said shank member including bearing means having a cylindrical bearing surface for engaging the respective cylindrical and planar face bearing surfaces of said ring-like bearings for rotation about a shaft pivot axis;

a spring in said transverse bore; and a ball in said transverse bore at each bore end for resilient engagement with said aligned selected depression, only one ball being aligned and engaged in any given shank member pivot position.

11. The club of claim 10 wherein said club head has an inwardly directed set of shoulders having a set of respective facing edges, said shank member having an arcuate shield member adjacent to said facing edges to form a dirt shield with said shoulders.

12. The club of claim 10 wherein said shank member includes a socket member for receiving said club shaft, an intermediate member depending from the socket member, said intermediate member having said transverse bore therein, an arcuate circular flange portion extending from said intermediate member, a circular disc depending at an edge thereof from the flange portion, and a pair of circular journal bearing members projecting in opposite directions from said disc coaxial with said disc circular bore to form a pair of coaxial cylindrical bearing surfaces.

13. A golf club comprising:

a head having a side wall bearing a golf ball impact surface, a circular segment sole surface having a heel and a toe and a pair of facing spaced shoulders depending inwardly from said heel and toe toward one another, said side wall, sole, heel, toe and shoulders defining a cavity, said head including a first abutment upstanding from said side wall intermediate said shoulders outside said cavity, a set of spaced depressions in said abutment lying on a circumferential line at a given radial distance from a given axis and a given spacing from a reference plane;

a first circular cylindrical bearing member secured to said side wall in said cavity, said bearing member defining a bearing axis coincident with said given axis, said bearing member having a circular ring-like planar outer bearing face normal to said bearing axis;

a head member having a side wall bearing a golf ball impact surface secured abutting said head to enclose said cavity, said head member including a second abutment upstanding therefrom outside the cavity facing the first abutment, the second abutment having a plurality of spaced depressions lying on a circumferential line at said radial distance from said given axis, the angular spacing of the first abutment depressions from said reference plane being different than the angular spacing of the second abutment depressions from that reference plane, said head member including a second circular cylindrical bearing member projecting from its side wall and having a cylindrical bearing surface coaxial with said bearing axis and a circular ring-like planar outer face normal to the bearing axis and facing the outer face of the first cylindrical bearing member;

a shank pivot member including means for receiving a club shaft on a shaft axis, said pivot member including a circular cylindrical disc secured at a disc edge to the pivot member, said disc having a pair of spaced planar faces, each facing and corresponding to a different ring-like outer face, and including a pair of circular cylindrical bearing members each for engaging the cylindrical bearing surface of a different cylindrical bearing, said pivot member including a transverse bore normal to and intersecting said shaft axis and parallel to said bearing axis, said transverse bore being spaced from said given axis said given radial distance;

a compression spring in said transverse bore; and a pair of balls in said bore, one ball at each bore end and dimensioned to engage said depressions whereby only one ball engages one depression for a given angular shaft axis position about said pivot axis.

* * * * *